US008787810B2

(12) United States Patent
Sakakibara et al.

(10) Patent No.: US 8,787,810 B2
(45) Date of Patent: Jul. 22, 2014

(54) FIXING ROTATING MEMBER AND FIXING DEVICE EQUIPPED WITH THE SAME

(75) Inventors: Hiroyuki Sakakibara, Yokohama (JP); Noriaki Sato, Suntou-gun (JP); Shuji Saito, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 180 days.

(21) Appl. No.: 13/357,415

(22) Filed: Jan. 24, 2012

(65) Prior Publication Data

US 2012/0195654 A1 Aug. 2, 2012

(30) Foreign Application Priority Data

Jan. 27, 2011 (JP) ..... 2011-015344

(51) Int. Cl.
*G03G 15/20* (2006.01)

(52) U.S. Cl.
CPC ..... *G03G 15/20* (2013.01); *G03G 15/2003* (2013.01); *G03G 15/2064* (2013.01); *G03G 15/2078* (2013.01); *G03G 15/2082* (2013.01); *G03G 2215/2016* (2013.01)
USPC ..... 399/333; 427/375

(58) Field of Classification Search
CPC ..... G03G 15/20
USPC ..... 399/324, 333
See application file for complete search history.

(56) References Cited

U.S. PATENT DOCUMENTS 3,810,735 A * 5/1974 Moser ..... 432/59
4,147,832 A * 4/1979 Namiki ..... 428/375
4,329,565 A * 5/1982 Namiki et al. ..... 219/216
4,434,355 A * 2/1984 Inagaki et al. ..... 219/216
4,530,140 A * 7/1985 Okamura et al. ..... 492/50
5,331,385 A 7/1994 Ohtsuka
5,724,637 A * 3/1998 Senba et al. ..... 399/333
6,094,559 A * 7/2000 Otsuka et al. ..... 399/327
8,082,842 B2 * 12/2011 Gervasi et al. ..... 101/141
8,263,199 B2 * 9/2012 Nakajima et al. ..... 428/36.9
8,401,451 B2 * 3/2013 Nakajima et al. ..... 399/333
2002/0011476 A1 * 1/2002 Otsuka ..... 219/216
2002/0020693 A1 * 2/2002 Otsuka et al. ..... 219/216
2010/0055365 A1 * 3/2010 Nakajima et al. ..... 428/36.9
2011/0142509 A1 * 6/2011 Nakajima et al. ..... 399/333

(Continued)

FOREIGN PATENT DOCUMENTS

CN 1245515 A 2/2000
CN 1787904 A 6/2006

(Continued)

OTHER PUBLICATIONS

Wikipedia, http://en.wikipedia.org/wiki/Triboelectric_effect, modified Sep. 2013 10:57.*

*Primary Examiner* — Clayton E Laballe
*Assistant Examiner* — Kevin Bulter
(74) *Attorney, Agent, or Firm* — Canon U.S.A., Inc., IP Division

(57) ABSTRACT

A fixing rotating member configured to, together with a pressure member, pinch and transport a recording material carrying an image includes a base material and a releasing layer, wherein the releasing layer is made of at least one fluorine resin selected from among tetrafluoroethylene-perfluoroalkyl vinyl ether copolymer, ethylene-tetrafluoroethylene copolymer, and tetrafluoroethylene-hexafluoropropylene copolymer, the fluorine resin containing at least one type of polymer selected from among polyvinylidene fluoride, polyacrylonitrile, and polymethyl methacrylate, and monomer electrolyte.

38 Claims, 3 Drawing Sheets

(56) References Cited

U.S. PATENT DOCUMENTS

| | | | | |
|---|---|---|---|---|
| 2012/0170958 | A1* | 7/2012 | Nakajima et al. | 399/333 |
| 2012/0195654 | A1* | 8/2012 | Sakakibara et al. | 399/328 |
| 2012/0195657 | A1* | 8/2012 | Sakakibara et al. | 399/339 |
| 2012/0195658 | A1* | 8/2012 | Sakakibara et al. | 399/339 |
| 2012/0315418 | A1* | 12/2012 | Nakajima et al. | 428/35.9 |
| 2013/0224514 | A1* | 8/2013 | Sugiyama et al. | 428/625 |
| 2013/0225380 | A1* | 8/2013 | Nakajima et al. | 492/53 |

FOREIGN PATENT DOCUMENTS

| | | | | |
|---|---|---|---|---|
| EP | 726506 | A1 | 8/1996 | |
| EP | 1388765 | A2 | 2/2004 | |
| JP | 04-019687 | A | 1/1992 | |
| JP | 3102317 | B2 | 10/2000 | |
| JP | 2007-63569 | A | 3/2007 | |
| JP | 2008-222942 | A | 9/2008 | |
| JP | 2008222942 | * | 9/2008 | C08K 5/42 |
| TW | 200950961 | A | 12/2009 | |

* cited by examiner

FIXING ROTATING MEMBER AND FIXING DEVICE EQUIPPED WITH THE SAME

This application claims priority from Japanese Patent Application No. 2011-015344 filed Jan. 27, 2011, which is hereby incorporated by reference herein in its entirety.

BACKGROUND OF THE INVENTION

1. Field of the Invention

The present invention relates to a fixing rotating member suitable for use in a fixing device mounted in an image forming apparatus, such as an electrophotographic copying machine and an electrophotographic printer, and a fixing device including the fixing rotating member.

2. Description of the Related Art

As fixing devices mounted in electrophotographic printers or electrophotographic copying machines, there has been known a heat roller-type fixing device including a halogen heater, a fixing roller heated by the halogen heater, and a pressure roller brought into contact with the fixing roller to form a nip portion.

Additionally, there has been known a film heating-type fixing device which includes a heater having a heat generating resistor formed on a substrate made of ceramics, a fixing film moving on the heater while being brought into contact with the heater, and a pressure roller forming a nip portion together with the heater with the fixing film being interposed therebetween.

Each of the heat roller-type fixing device and the film heating-type fixing device is configured to heat and fix a toner image onto a recording material carrying an unfixed toner image thereon while the recording material is pinched and transported at the nip portion.

A releasing layer is generally provided on a surface layer of the fixing roller or fixing film (hereinafter, referred to as a fixing member) and a surface layer of the pressure roller, which are used in these types, to prevent the toner from adhering thereto. A fluorine resin can be used as the releasing layer.

However, since the fluorine resin is a high electrical insulation material, the fluorine resin has properties in which it is easily electrically charged and static electricity is hardly escaped therefrom. For this reason, if the recording material with the unfixed toner image is transported to the nip portion of the fixing device, an electrostatic offset image is likely to be formed in which the unfixed toner electrically adheres to a surface of the fixing member and is then fixed to the recording material when the fixing member revolves.

There are several kinds of the electrostatic offset. When a rear end of the recording material comes out from the fixing device, the surface of the fixing member is locally intensively electrically-charged by peeling electrification. Thus, when the electrified portion faces the recording material, an offset electric field is generated, which causes electrostatic offset. This happens on the image in a straight line in a main scanning direction (hereinafter, referred to as peeling offset).

Since the surface of the fixing member is very intensively electrically-charged, the peeling offset appears in a bad-looking image defect among several kinds of the electrostatic offset.

Accordingly, a method for dispersing a charge control agent onto the fluorine resin or a method for applying a voltage to the pressure roller to cancel the offset electric field has been proposed to prevent the fluorine resin of the releasing layer of the fixing member from being electrically charged during peeling.

For example, Japanese Patent Application Laid-Open No. 04-19687 discusses a fixing device including a fixing member having a heat generating element therein, and a pressure roller placed opposite to the fixing member in a freely rotating manner, in which the pressure roller has an electrically conductive core metal, an elastic layer formed on the core metal, and a surface layer of an electrically conductive PFA tube formed on the elastic layer.

Furthermore, Japanese Patent No. 3,102,317 discusses a pressure roller and a fixing device which are characterized in that the pressure roller includes an insulating surface layer formed on an outermost layer of the pressure roller, and at least one low-resistance layer formed inside the insulating surface layer and applied by a voltage, and the lateral surfaces of both ends of the pressure roller are coated with insulating material.

In addition, Japanese Patent Application Laid-Open No. 2008-222942 discusses a fluorine resin composition containing a fluorine resin, a fluoroalkylsulfonate, and no conductive particle, which is applied to a copying machine or a printer is also recorded therein.

However, the configurations of the prior art have the following issues on the peeling offset and the toner stain.

First, the toner stain will be described. The toner stain is the one in which the offset toner adheres to and accumulates on the surface layer of the pressure roller. A lump of toner adheres to the underside of the recording material at any timing, which causes an image defect.

In the case of the related art where the conductive PFA tube is provided as the surface layer of the pressure roller, the toner stain easily develops on the pressure roller. The conductive PFA tube is made by adding carbon into insulating PFA to produce conductivity. As compared with the insulating PFA tube with no conductive material, its peeling offset is superior, while its releasing property of the toner is inferior.

In addition, if the content of the carbon is reduced, the releasing property is improved, but the peeling offset is deteriorated. Accordingly, in the carbon-added conductive PFA tube, the peeling offset and the stain of the pressure roller are in a trade-off relationship.

In addition, in the configuration in which the insulating PFA tube is used on the surface layer of the pressure roller, and at least one low-resistance layer is formed inside the insulating surface layer and applied by a voltage, the applied voltage needs to be very high. The reason is that it is necessary to eliminate the offset electric field, which is generated by intensive peeling electrification of the surface layer of the fixing member through feeding of paper, by applying a voltage. In this instance, leak caused by partial insulation rupture or the like is likely to occur on the surface of the PFA tube.

Furthermore, although the peeling offset and the stain of the pressure roller were examined by applying a voltage while the content of the carbon was gradually reduced, an improvement in the peeling offset is not compatible with a reduction of the stain of the pressure roller.

Meanwhile, a tube including fluoroalkylsulfonate contained in the fluorine resin (PFA) has a tendency to improve the frictional electrification property with paper, as compared with the insulating PFA tube, but does not exhibit an effect on the peeling offset since the portion subjected to the peeling electrification has no electric charge decay performance.

As described above, it is desirable that a material having a high releasing property is used for the releasing layer of the pressure roller to suppress the toner stain of the pressure roller. In this instance, however, the peeling offset is deteriorated. Thus, it is desirable to reduce the peeling offset on the fixing rotating member irrespective of a material of the releasing layer of the pressure roller.

SUMMARY OF THE INVENTION

The present invention is directed to a fixing rotating member and a fixing device, in which an improvement in peeling offset is compatible with a reduction of a toner stain of a pressure roller.

According to an aspect of the present invention, a fixing rotating member configured to, together with a pressure member, pinch and transport a recording material carrying an image includes a base material and a releasing layer, wherein the releasing layer is made of at least one fluorine resin selected from among tetrafluoroethylene-perfluoroalkyl vinyl ether copolymer, ethylene-tetrafluoroethylene copolymer, and tetrafluoroethylene-hexafluoropropylene copolymer, the fluorine resin containing at least one type of polymer selected from among polyvinylidene fluoride, polyacrylonitrile, and polymethyl methacrylate, and monomer electrolyte.

According to another aspect of the present invention, a fixing device includes a fixing rotating member including a base material and a releasing layer, and a pressure member forming, together with the fixing rotating member, a nip portion configured to heat, while pinching and transporting, a recording material carrying an image, wherein the releasing layer is made of at least one fluorine resin selected from among tetrafluoroethylene-perfluoroalkyl vinyl ether copolymer, ethylene-tetrafluoroethylene copolymer, and tetrafluoroethylene-hexafluoropropylene copolymer, the fluorine resin containing at least one type of polymer selected from among polyvinylidene fluoride, polyacrylonitrile, and polymethyl methacrylate, and monomer electrolyte.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

(1) Fixing Device 6

Figure 1:
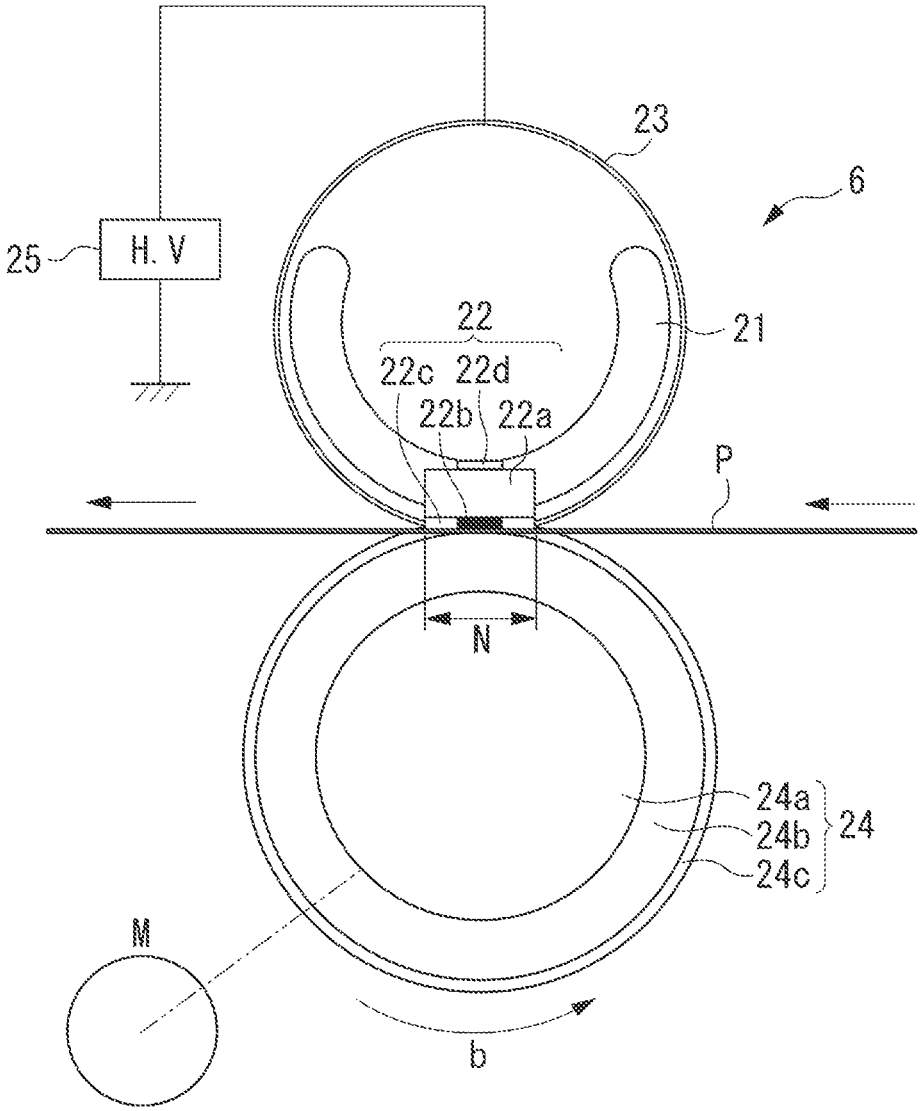
FIG. 1 is a schematic diagram illustrating a fixing device according to an exemplary embodiment of the present invention.

The configuration of an image forming apparatus equipped with a fixing device is known in the art, and thus its description will be omitted. FIG. 1 is a schematic diagram illustrating a fixing device 6 according to an exemplary embodiment of the present invention. A film guide member (stay) 21 has a transverse section formed in a substantially semi-circular arc and gutter shape and is transversely long in a longitudinal direction corresponding to a direction perpendicular to the drawing. A transversely long heater 22 is received and held in a groove substantially formed at the center of the lower surface of the film guide member 21 in a longitudinal direction. An endless belt-type heat-resistant belt (fixing film) 23 is loosely fitted to the outside of the film guide member 21 attached with the heater 22. Components 21 to 23 configure a heating member according to the present exemplary embodiment. A pressure roller 24 is brought into press-contact with the lower surface of the heater 22, with the heat-resistant belt 23 being interposed between the heater 22 and the pressure roller 24.

A nip portion N is formed by the heater 22 and the pressure roller 24, with the heat-resistant belt 23 being interposed between the heater 22 and the pressure roller 24. The pressure roller 24 is rotated by a driving source M. The film guide member 21 is a molding product made of a heat-resistant resin, such as polyphenylene sulfide (PPS) or liquid crystal polymer.

The heater 22 is a ceramic heater having low thermal capacity. Specifically, the heater 22 includes a heater substrate 22*a*, such as alumina or AlN, formed in a transversely long thin plate shape, a resistance heat generating element 22*b* of a linear shape or a narrow band shape, such as Ag/Pd, formed on a surface (film sliding surface) of the substrate in a longitudinal direction, a thin surface protection layer 22*c*, such as glass layer, and a temperature measuring element 22*d* such as a thermistor provided on the opposite surface of the heater substrate 22*a*. The temperature of the ceramic heater 22 promptly increases upon supplying power to the resistance heat generating element 22*b*, and the heater 22 is controlled at a predetermined fixing temperature (target temperature to be controlled) by a power control unit including the temperature measuring element 22*d*.

In order to improve quick start performance of the fixing device by decreasing the thermal capacity of the heat-resistant belt 23, the heat-resistant belt 23 is configured as a composite-layered film having a film thickness of 400 μm or less in total, desirably, in the range of 50 μm to 300 μm inclusive.

The pressure roller 24 includes a core metal 24*a* made of, for example, iron or aluminum material, a rubber elastic layer 24*b*, and a releasing layer 24*c*.

If necessary, a voltage applying circuit (voltage applying unit) 25 for electrically holding the toner on the recording material P at the fixing nip portion N may be electrically connected to the heat-resistant belt 23.

The connected position of the heat-resistant belt 23 is not particularly limited if it is a conductive portion. The connected portion may be appropriately selected. Furthermore, according to an exemplary embodiment of the present invention, increasing the number of layers forming the heat-resistant belt 23 is acceptable for the electrical connection.

The voltage applying circuit may be connected to the heat-resistant belt 23, or may be connected to the pressure roller 24. Alternatively, the voltage applying circuit may be separately connected to the fixing belt 23 and the pressure roller 24.

The heat-resistant belt 23 is rotated by the rotation of the pressure roller 24 when the pressure roller 24 rotates in a counterclockwise direction indicated by the arrow b during at least the image forming process. That is, when the pressure roller 24 is rotationally driven, a rotary force acts on the heat-resistant belt 23 at the fixing nip portion N in terms of a friction force between the outer peripheral surface of the pressure roller 24 and the outer peripheral surface of the heat-resistant belt 23. When the heat-resistant belt 23 rotates, the inner surface of the heat-resistant belt 23 slides on the lower surface which is the surface of the heater 22 at the nip portion N in a close contact manner. In this instance, in order to reduce sliding resistance between the inner surface of the heat-resistant belt 23 and the lower surface of the heater 22, lubricant such as thermal resistant grease may be interposed therebetween.

While the recording material P is transported and nipped at the fixing nip portion N, the toner image carried on the recording material P is heated and fixed onto the recording material P. The recording material P passing through the nip portion N is separated from the outer surface of the heat-resistant belt 23, and then is transported.

Since the film heating-type heat-fixing device 6 according to the present exemplary embodiment includes the heater 22 which has the low thermal capacity and in which a temperature promptly increases, it is possible to remarkably reduce a time for the heater 22 arriving at the predetermined temperature. Since the temperature of the heater can be easily increased up to the high-temperature from a room temperature, and it is not necessary to control the temperature of the fixing device in a standby state during a non-printing process, thereby saving power. Additionally, a tension is not substantially applied to the rotating heat-resistant belt 23 at a portion other than the fixing nip portion N, and only a flange member is provided as a film movement regulator to just support the end portion of the heat-resistant belt 23.

(2) Heat-Resistant Belt 23

Hereinafter, a material and a method for forming the heat-resistant belt 23 in the above-described fixing device 6 will be described in detail.

2-1) Layer Configuration of Heat-Resistant Belt (Fixing Belt) 23

Figure 2:
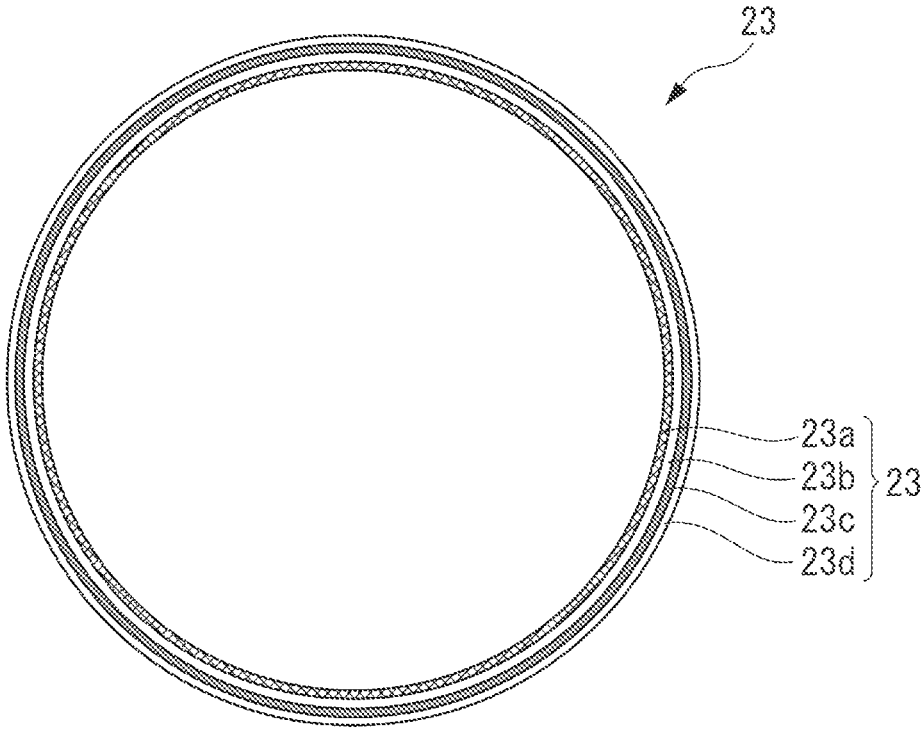
FIG. 2 is a schematic diagram illustrating the layer configuration of a heat-resistant belt.

FIG. 2 is a schematic diagram of the layer configuration of the heat-resistant belt (fixing belt) 23. The heat-resistant belt (fixing belt) 23 is a rotating body for fixing in which at least the following layers are laminated around the outer periphery of the substrate 23*a*.

1: A releasing layer 23*d* formed of at least one fluorine resin selected from among tetrafluoroethylene-perfluoroalkyl vinyl ether copolymer, ethylene-tetrafluoroethylene copolymer, and tetrafluoroethylene-hexafluoropropylene copolymer, the fluorine resin containing at least one polymer selected from among polyvinylidene fluoride, polyacrylonitrile, and polymethyl methacrylate, and monomer electrolyte. If necessary, the following layers may also be added.

2: An elastic layer 23*b* formed of a flexible and heat-resistant material, which is represented by a silicone rubber.

3: An adhesive layer 23*c* for causing the elastic layer 23*b* and the releasing layer 23*d* to adhere to each other.

Furthermore, pluralization of the layers does not pose any issue as long as the layers do not impair the function of the present exemplary embodiment.

2-1-1) Base Material 23*a*

As the base material 23*a*, a heat-resistant resin, for example, metal such as aluminum, iron, stainless steel, or nickel, alloy metal, and polyimide, is used.

2-1-2) Elastic Layer 23*b*

The elastic layer 23*b* is configured to give elasticity to the heat-resistant belt 23 to increase the contact area between the toner and the heat-resistant belt during fixing.

Since the elasticity can be adjusted depending upon a kind or content of a filler while presenting such a function, it is desirable that the elastic layer 23*b* is made of a hardened material of addition cure-type silicone rubber. In addition, the elasticity can be adjusted by controlling a degree of cross-linking.

The formation of the elastic layer 23*b* on the base material 23*a* is achieved by a forming method known in the art, for example, a ring coating method or a beam coating method.

2-1-3) Adhesive Layer 23*c*

The adhesive layer 23*c* may be formed using any of a silicone rubber adhesive type and a silicone primer type. If the adhesive layer is a silicone rubber adhesive type, the elastic layer 23*b* and the releasing layer 23*d* can firmly adhere to each other by using the following materials.

Type A: Addition-type silicone rubber adhesive which is commercially available.

Type B: Composition configured by combining addition-type silicone rubber composition having no adhesive impregnation agent with an adhesive impregnation agent.

Various conductivity imparting agents or antistatic agents may also be used as fillers in the silicone rubber adhesive. Examples of the conductivity imparting agents include conductive carbon black, graphite, powdered metal such as silver, copper, and nickel, conductive zinc oxide, conductive calcium carbonate, and carbon fibers, but conductive carbon black is generally used.

Furthermore, a polyether system or an ion conductive antistatic agent may be used as the antistatic agent; however, in view of heat resistance, an ion conductive antistatic agent is desirable, and a lithium salt or a potassium salt is suitable.

2-1-4) Releasing Layer 23*d*

The releasing layer 23*d* provided on the heat-resistant belt 23 is characterized in that the releasing property on the toner maintains the property of the pure fluorine resin, and its electric charge decay performance is high. The reason is that an additive contained in the fluorine resin (PFA, ETFE, or FEP) of the main binder is present in small amounts, and thus the charge decay performance is high.

First, the releasing layer 23*d* of the heat-resistant belt 23 contains at least one polymer selected from among polyvinylidene fluoride (PVDF), polyacrylonitrile (PAN), and polymethyl methacrylate (PMMA), and monomer electrolyte in the fluorine resin (PFA, ETFE, or FEP) of the main binder.

Specific examples of the fluorine resin that serves as the main binder include the following: ethylene-tetrafluoroethylene copolymer (ETFE), tetrafluoroethylene-perfluoroalkyl vinyl ether copolymer (PFA), and tetrafluoroethylene-hexafluoropropylene copolymer (FEP). Among them, PFA and ETFE are more desirable in view of moldability, heat resistance, and flex resistance.

The polymer that is contained in the fluorine resin (PFA, ETFE or FEP) of the main binder is desirably polyvinylidene fluoride (PVDF), polyacrylonitrile (PAN), or polymethyl methacrylate (PMMA).

The following effects are achieved by adding the polymer. In the fluorine resin (PFA, ETFE or FEP) as the main binder of the releasing layer 23*d*, since the fluorine resin has high crystallinity, if the monomer electrolyte, which will be described below, is contained alone, the ion mobility of the segregated electrolyte cannot be sufficiently secured.

It is estimated that the ion can move in the polymer by adding a small amount of electrolyte contained in the fluorine resin (PFA, ETFE, or FEP) as polymer electrolyte (monomer electrolyte+polymer), so the ion mobility of the electrolyte is significantly increased, without losing the inherent properties of the fluorine resin. As the result of extensive studies about the selected polymer, a desirable one has been found.

Among the polymers described above, polyvinylidene fluoride (PVDF) is desirable from the viewpoints of affinity with the solvent, thermal and chemical stability, and compatibility with the fluorine resin.

The amount of addition of polyvinylidene (PVDF), polyacrylonitrile (PAN) or polymethyl methacrylate (PMMA) to the fluorine resin is desirably in the range of 0.05 parts to 5 parts relative to 100 parts of the fluorine resin. Here, the amount of addition is only the amount of the raw material, which does not include the amount of the solvent. If the amount of addition is 0.05 parts or less, the charge reducing effect is insufficient, and if the amount of addition is 5 parts or more, processability is deteriorated. The polyvinylidene fluoride (PVDF), polyacrylonitrile (PAN), and polymethyl methacrylate (PMMA) may be used singly, or may be used as mixtures.

It is desirable that the monomer electrolyte to be contained in the fluorine resin (PFA, ETFE or FEP) of the main binder is a fluorine-based surfactant, from the viewpoint of high heat resistance. Among fluorine-based surfactants, the following substances selected from among sulfonic acids, disulfonic acids, sulfonimides, and sulfonamides of fluoroalkylsulfonic acid derivatives are suitably used.

Examples of the sulfonic acids include lithium trifluoromethanesulfonate, potassium trifluoromethanesulfonate, sodium trifluoromethanesulfonate, ammonium trifluoromethanesulfonate, potassium pentafluoroethanesulfonate, lithium pentafluoroethanesulfonate, sodium pentafluoroethanesulfonate, ammonium pentafluoroethanesulfonate, potassium heptafluoropropanesulfonate, lithium heptafluoropropanesulfonate, sodium heptafluoropropanesulfonate, ammonium heptafluoropropanesulfonate, potassium nonafluorobutanesulfonate, lithium nanofluorobutanesulfonate, sodium nonafluorobutanesulfonate, ammonium nonafluorobutanesulfonate, potassium perfluorobutanesulfonate, and lithium perfluorobutanesulfonate.

Examples of the disulfonic acids include 1,1,2,2,3,3-hexafluoropropane-1,3-disulfonic acid, 1,1,2,2,3,3-hexafluoropropane-1,3-disulfonic acid dipotassium salt, 1,1,2,2,3,3-hexafluoropropane-1,3-disulfonic acid disodium salt, 1,1,2,2,3,3-hexafluoropropane-1,3-disulfonic acid diammonium salt, and 1,1,2,2,3,3-hexafluoropropane-1,3-disulfonic acid dilithium salt.

Examples of the sulfonimides include bis(heptafluoropropanesulfonyl)imide potassium salt, bis(heptafluoropropanesulfonyl)imide lithium salt, bis(heptafluoropropanesulfonyl)imide sodium salt, bis(heptafluoropropanesulfonyl)imide ammonium salt, bis(nonafluorobutanesulfonyl)imide potassium salt, bis(nonafluorobutanesulfonyl)imide sodium salt, bis(nonafluorobutanesulfonyl)imide ammonium salt, bis(nonafluorobutanesulfonyl)imide lithium salt, cyclohexafluoropropane-1,3-bis(sulfonyl)imide potassium salt, cyclohexafluoropropane-1,3-bis(sulfonyl)imide sodium salt, cyclohexafluoropropane-1,3-bis(sulfonyl)imide ammonium salt, and cyclohexafluoropropane-1,3-bis(sulfonyl)imide lithium salt.

Examples of the sulfonamides include trifluoromethanesulfonamide potassium salt, pentafluoroethanesulfonamide, pentafluoroethanesulfonamide potassium salt, heptafluoropropanesulfonamide, heptafluoropropanesulfonamide potassium salt, and nonafluorobutanesulfonamide potassium salt.

The fluoroalkylsulfonic acid derivatives have very high decomposition temperatures and exhibit high ion conductivity, and therefore, the derivatives are suitable to be contained in the fluorine resins (PFA, ETFE and FEP). The amount of addition of the fluoroalkylsulfonic acid derivatives into the fluorine resin is desirably in the range of 0.05 parts to 5 parts inclusive relative to 100 parts of the fluorine resin. Here, the amount of addition is the amount of the raw material only, which does not include the amount of the solvent. If the amount of addition is 0.05 parts or less, the charge reducing effect is insufficient, and if the amount of addition is 5 parts or more, processability is deteriorated.

The incorporation of the fluorine resin (PFA, ETFE or FEP) may be carried out by mixing the at least one polymer selected from among polyvinylidene fluoride (PVDF), polyacrylonitrile (PAN) and polymethyl methacrylate (PMMA), and the monomer electrolyte into the fluorine resin (PFA, ETFE or FEP), and melting the mixture.

It is desirable to manufacture the releasing layer in the tube shape by using the material through a forming method known in the art, for example, an extrusion method, from the viewpoint of superior strength and durability.

The fluorine resin tube of the releasing layer 23*d* may be coated after the adhesive layer 23*c* is applied thereon, or may be formed by using a technique in which the fluorine resin tube is set in the molding die in advance.

The releasing layer 23*d* provided on the heat-resistant belt 23 is characterized in that the releasing property on the toner maintains the property of the pure fluorine resin, and its electric charge decay performance is high. Furthermore, the heat-resistant belt 23 can have more superior charge decay performance by lowering the resistance of the adhesive layer 23*c* of the heat-resistant belt 23 or by giving antistatic performance to the heat-resistant belt.

In addition, it can further increase the effect of suppressing the peeling offset by applying the voltage to the heat-resistant belt 23 from the voltage applying unit. The voltage applying unit may be provided to the heat-resistant belt 23 or may be provided to both the heat-resistant belt 23 and the pressure roller 24.

In addition to the film heating type according to the present exemplary embodiment, other types, for example, a type of using a heat roller as a fixing rotating member, can achieve the same effect by adapting the configuration including the releasing layer, the elastic layer, the adhesive layer for causing the releasing layer and the elastic layer to adhere to each other, and the voltage applying unit, which are described hereinabove, for the exemplary embodiment discussed herein.

Hereinafter, the present invention will now be described in detail by use of Examples.

EXAMPLE 1

First, a SUS material having a profile of Φ30 mm and a thickness of 30 μm is used as the substrate 23*a* of the heat-resistant belt, and a silicone rubber elastic layer 23*b* containing an added alumina filler is formed to a thickness of 250 μm on the substrate (hereinafter, referred to as a belt-shaped molding product A).

Subsequently, as the adhesive layer 23*c*, a product produced by adding ketjen black EC600-JD (trade name, manufactured by Lion Corp.) as a conductive carbon black to an addition cure-type silicone rubber adhesive (trade name: SE1819CV, "Liquid A" and "Liquid B" manufactured by Dow Corning Toray Co., Ltd. are mixed in equal amounts to make up 100 parts), and adjusting the volume resistance value to $10^9$ Ω·cm, is used, and is uniformly coated on the belt-shaped molding product A to a thickness of 20 μm (hereinafter, referred to as a belt-shaped molding product B).

The releasing layer 23*d* is produced into a tube shape having a thickness of 25 μm, and a mixture containing 0.5 parts of polyvinylidene fluoride (PVDF) and 0.5 parts of lithium trifluoromethanesulfonate (CF3SO3Li) relative to 100 parts of PFA (trade name: 451HP-J) manufactured by DuPont Company as the main binder, is used.

The belt-shaped molding product B is coated with the fluorine resin tube which is the above-described releasing layer 23*d*, and then is subjected to heat curing at a temperature of 200° C. for 4 hours. After that, extra end portions are cut to obtain the heat-resistant belt 23 according to this Example.

The pressure roller 24 including a core metal 24*a* made of iron material having a profile of Φ23 mm, a conductive silicone rubber elastic layer 24*b* having a body thickness of 3.5 mm formed on the core metal 24*a*, and a releasing layer 24*c*, which is the outermost layer, formed on the silicone rubber elastic layer by coating insulating PFA having a thickness of 50 μm on the silicone rubber elastic layer is used.

The base material 23*a* of the heat-resistant belt 23 is applied by a negative 600 V from the voltage applying circuit 25, and the core metal 24*a* of the pressure roller 24 is grounded.

(Peeling Offset Evaluation)

The peeling offset was evaluated by the following method. The peeling offset was evaluated by assembling the fixing device according to this Example to HP-Laser jet P4515 (A4 60 sheets/minute), which is a laser beam printer (LBP)), and continuously feeding 50 sheets of Neenah Bond 60 g/m2 paper, which were manufactured by Neenah Paper company, and were left under circumstances of low temperature and low humidity (15° C./10%), while a halftone image pattern was printed thereon. In addition, as the toner for use in this evaluation, the evaluation was performed by using negative toner having a property to be negatively charged.

The evaluation is classified into the followings.

⊙: The peeling offset does not occur at all.

○: The peeling offset occurs very slightly and partially in a level which can be seen when looked at carefully.

Δ: The peeling offset occurs slightly and partially in a level which does not matter.

x: The peeling offset occurs in the shape of sharp streak in the whole area along a longitudinal direction.

(Toner Stain)

The toner stain was evaluated by using 75 g/m2 (trade name: X-9) manufactured by Boise Cascade company, of which calcium carbonate was a loading material.

In the printing mode of repeating a process in which 2 sheets of paper was fed by using the above-described LBP and the fixing device according to this Example, and then the LBP and the fixing device were left for 10 minutes under circumstances of low temperature and low humidity (15° C./10%), after 5000 sheets of paper was fed, the stain of the pressure roller was evaluated and then the evaluation was classified into the followings.

⊙: The pressure roller is not stained.

○: The pressure roller is slightly stained, but the stain does not adhere to the paper.

x: The pressure roller is stained severely, and the stain adheres to the paper.

EXAMPLES 2 to 4

Examples 2 to 4 are similar to Example 1, except that the contained amount of polyvinylidene fluoride (PVDF) relative to 100 parts of PFA, which is the main binder of the fluorine resin tube of the releasing layer 23*d*, is changed as indicated in Table 1.

EXAMPLES 5 to 7

Examples 5 to 7 are similar to Example 1, except that the contained amount of lithium trifluoromethanesulfonate (CF3SO3Li) relative to 100 parts of PFA, which is the main binder of the fluorine resin tube of the releasing layer 23*d*, is changed as indicated in Table 1.

EXAMPLE 8

Example 8 is similar to Example 1, except that a product produced by incorporating 0.5 parts of polyacrylonitrile (PAN) and 0.5 parts of lithium trifluoromethanesulfonate (CF3SO3Li) to 100 parts of PFA (trade name: 451HP-J) manufactured by DuPont Company as the main binder, is used for the fluorine resin tube of the releasing layer 23*d*.

EXAMPLE 9

Example 9 is similar to Example 1, except that a product produced by incorporating 0.5 parts of polymethyl methacrylate (PMMA) and 0.5 parts of lithium trifluoromethanesulfonate (CF3SO3Li) to 100 parts of PFA (trade name: 451HP-J) manufactured by DuPont Company as the main binder, is used for the fluorine resin tube of the releasing layer 23*d*.

EXAMPLE 10

Example 10 is similar to Example 1, except that a product produced by incorporating 0.5 parts of polyvinylidene fluoride (PVDF) and 0.5 parts of 1,1,2,2,3,3-hexafluoropropane-1,3-disulfonic acid dilithium salt (LiO3SCF2CF2CF2SO3Li) to 100 parts of PFA (trade name: 451HP-J) manufactured by DuPont Company as the main binder, is used for the fluorine resin tube of the releasing layer 23*d*.

EXAMPLE 11

Example 11 is similar to Example 1, except that a product produced by incorporating 0.5 parts of polyvinylidene fluoride (PVDF) and 0.5 parts of cyclohexafluoropropane-1,3-bis (sulfonyl)imide potassium salt (CF2(CF2SO2)2NK) to 100 parts of PFA (trade name: 451HP-J) manufactured by DuPont Company as the main binder, is used for the fluorine resin tube of the releasing layer 23*d*.

EXAMPLE 12

Example 12 is similar to Example 1, except that a product produced by incorporating 0.5 parts of polyvinylidene fluoride (PVDF) and 0.5 parts of nonafluorobutanesulfonamide potassium salt (C4F9SO2NHK) to 100 parts of PFA (trade name: 451HP-J) manufactured by DuPont Company as the main binder, is used for the fluorine resin tube of the releasing layer 23*d*.

EXAMPLE 13

Example 13 is similar to Example 1, except that a product produced by adding Ketjen black EC600-JD (trade name, manufactured by Lion Corp.) as a conductive carbon black, to an addition cure-type silicone rubber adhesive (trade name: SE1819CV; "Liquid A" and "Liquid B" manufactured by Dow Corning Toray Co., Ltd. are mixed in equal amounts to make up 100 parts), and adjusting the volume resistance value to $10^{11}$ Ω·cm, is used as the adhesive layer 23*c*.

EXAMPLE 14

Example 14 is similar to Example 1, except that a product produced by adding lithium trifluoromethanesulfonate (CF3SO3Li) as a monomer electrolyte, to an addition cure-type silicone rubber adhesive (trade name: SE1819CV, "Liquid A" and "Liquid B" manufactured by Dow Corning Toray Co., Ltd. are mixed in equal amounts to make up 100 parts), and adjusting the volume resistance value to $10^{13}$ Ω·cm, is used as the adhesive layer 23*c*.

EXAMPLE 15

Example 15 is similar to Example 1, except that a product produced by adding Ketjen black EC600-JD (trade name, manufactured by Lion Corp.) as a conductive carbon black and lithium trifluoromethanesulfonate (CF3SO3Li) as a monomer electrolyte, to an addition cure-type silicone rubber adhesive (trade name: SE1819CV; "Liquid A" and "Liquid B" manufactured by Dow Corning Toray Co., Ltd. are mixed in equal amounts to make up 100 parts), and adjusting the volume resistance value to $10^{12}$ Ω·cm, is used for the adhesive layer 23*c*.

EXAMPLE 16

Example 16 is similar to Example 1, except that an addition cure-type silicone rubber adhesive (trade name: SE1819CV; "Liquid A" and "Liquid B" manufactured by Dow Corning Toray Co., Ltd. are mixed in equal amounts to make up 100 parts) is used as the adhesive layer 23*c*.

EXAMPLE 17

Example 17 is similar to Example 1, except that the heat-resistant belt 23 is not applied by the voltage and the base material is grounded.

EXAMPLE 18

Figure 3:
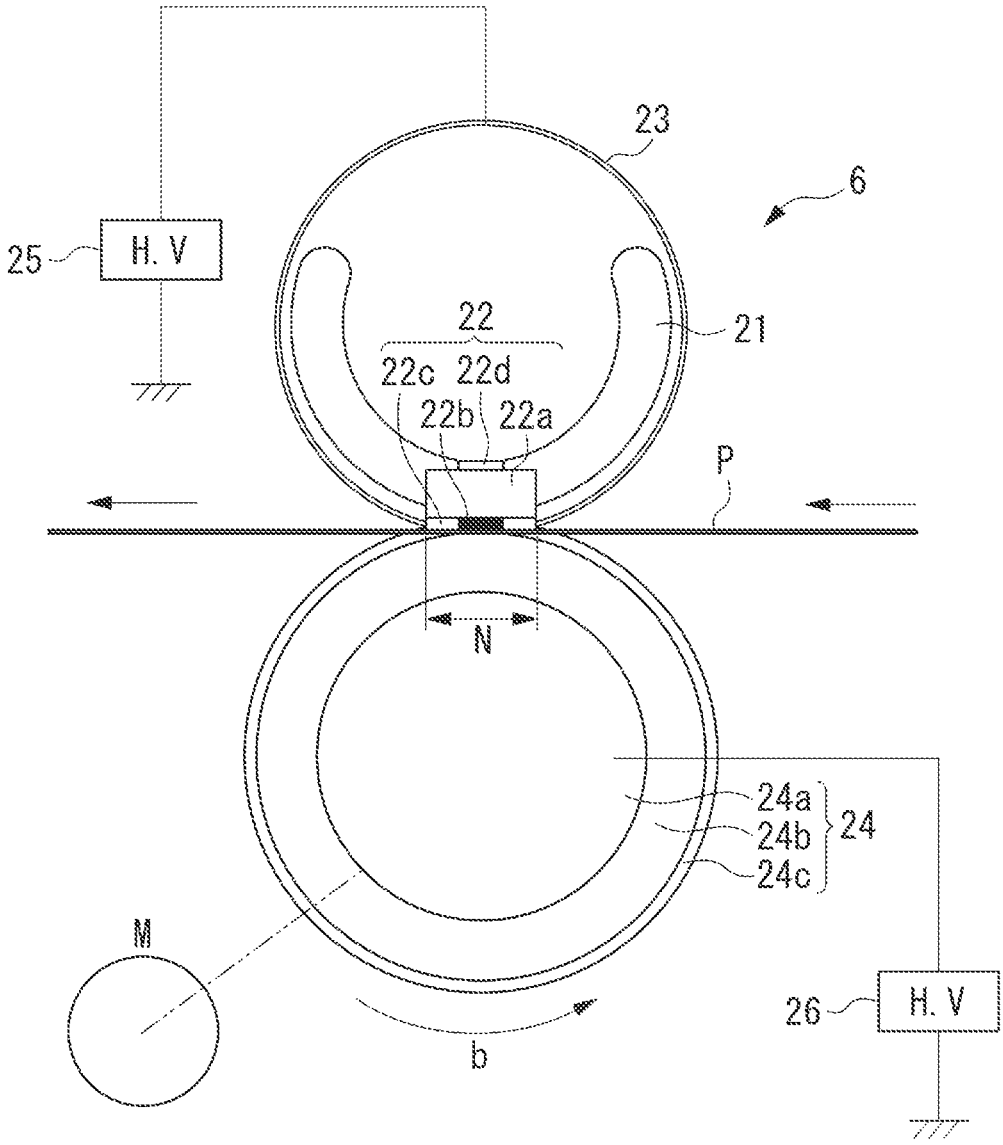
FIG. 3 is a diagram of Example 18.

As illustrated in FIG. 3, two voltage applying circuits 25 and 26 are provided to the fixing device 6, in which one applies a positive voltage of 400 V to the core metal 24*a* of the pressure roller 24, while the other applies a negative voltage of 600 V to the base material of the heat-resistant belt 23, as described in Example 1. In addition, the heat-resistant belt 23 is similar to Example 1.

EXAMPLE 19

The elastic layer is not formed on the base material 23*a* of the heat-resistant belt 23, which is substantially similar to Example 1, and the adhesive layer 23*c* and the release layer 23*d*, which are similar to Example 1, are formed on the base material 23*a*. The pressure roller 24 and the voltage applying circuit 25 are also formed similar to those of Example 1.

COMPARATIVE EXAMPLE 1

The base material 23*a* and the elastic layer 23*b* use those similar to Example 1, and the adhesive layer 23*c* has only addition cure-type conductive silicone rubber adhesive (trade name: SE1819CV; 50 parts Liquid A and 50 parts Liquid B, manufactured by Dow Corning Toray Co., Ltd. are mixed with together at a proportion of 1:1). The fluorine resin tube of the releasing layer 23*d* has only PFA (trade name: 451HP-J) manufactured by DuPont company as a main binder. The heat-resistant belt 23 and the pressure roller 24 are grounded without applying the voltage thereto.

COMPARATIVE EXAMPLE 2

Comparative Example 2 is similar to Comparative Example 1, except that a negative voltage of 600 V is applied to the base material 23*a* of the heat-resistant belt 23.

COMPARATIVE EXAMPLE 3

Comparative Example 3 has a similar configuration as Example 1, except that a product produced by incorporating 1.0 parts of lithium trifluoromethanesulfonate (CF3SO3Li) into 100 parts of PFA (trade name: 451HP-J) manufactured by DuPont Company as the main binder, is used for the fluorine resin tube of the releasing layer 23*d*.

COMPARATIVE EXAMPLE 4

Comparative Example 4 is similar to Comparative Example 1, except that the fluorine resin tube of the releasing layer 24*c* of the pressure roller 24 has only low-resistant PFA (trade name: C-9068) manufactured by DuPont company.

Evaluations of Examples and Comparative Examples are summarized in Table 1.

TABLE 1

| | Releasing layer 23d of heat-resistant belt | | | |
|---|---|---|---|---|
| | Material 1 | | Material 2 | |
| Example 1 | PVDF | 0.5 parts | $CF_3SO_3Li$ | 0.5 parts |
| Example 2 | PVDF | 0.01 parts | $CF_3SO_3Li$ | 0.5 parts |
| Example 3 | PVDF | 0.05 parts | $CF_3SO_3Li$ | 0.5 parts |
| Example 4 | PVDF | 5 parts | $CF_3SO_3Li$ | 0.5 parts |
| Example 5 | PVDF | 0.5 parts | $CF_3SO_3Li$ | 0.01 parts |
| Example 6 | PVDF | 0.5 parts | $CF_3SO_3Li$ | 0.05 parts |
| Example 7 | PVDF | 0.5 parts | $CF_3SO_3Li$ | 5 parts |
| Example 8 | PAN | 0.5 parts | $CF_3SO_3Li$ | 0.5 parts |
| Example 9 | PMMA | 0.5 parts | $CF_3SO_3Li$ | 0.5 parts |
| Example 10 | PVDF | 0.5 parts | $LiO_3SCF_2CF_2CF_2SO_3Li$ | 0.5 parts |
| Example 11 | PVDF | 0.5 parts | $CF_2(CF_2SO_2)_2NK$ | 0.5 parts |
| Example 12 | PVDF | 0.5 parts | $C_4F_9SO_2NHK$ | 0.5 parts |
| Example 13 | PVDF | 0.5 parts | $CF_3SO_3Li$ | 0.5 parts |
| Example 14 | PVDF | 0.5 parts | $CF_3SO_3Li$ | 0.5 parts |
| Example 15 | PVDF | 0.5 parts | $CF_3SO_3Li$ | 0.5 parts |
| Example 16 | PVDF | 0.5 parts | $CF_3SO_3Li$ | 0.5 parts |
| Example 17 | PVDF | 0.5 parts | $CF_3SO_3Li$ | 0.5 parts |
| Example 18 | PVDF | 0.5 parts | $CF_3SO_3Li$ | 0.5 parts |
| Example 19 | PVDF | 0.5 parts | $CF_3SO_3Li$ | 0.5 parts |
| Comparative Example 1 | None | — | None | — |
| Comparative Example 2 | None | — | None | — |
| Comparative Example 3 | None | — | $CF_3SO_3Li$ | 1.0 parts |
| Comparative Example 4 | None | — | None | — |

TABLE 1-continued

| | Adhesive layer 23c of heat-resistant belt | | Elastic layer |
|---|---|---|---|
| | Additive | Resistance (Ω · cm) | 23b of heat-resistant belt |
| Example 1 | Ketjen black | $10^9$ | Present |
| Example 2 | Ketjen black | $10^9$ | Present |
| Example 3 | Ketjen black | $10^9$ | Present |
| Example 4 | Ketjen black | $10^9$ | Present |
| Example 5 | Ketjen black | $10^9$ | Present |
| Example 6 | Ketjen black | $10^9$ | Present |
| Example 7 | Ketjen black | $10^9$ | Present |
| Example 8 | Ketjen black | $10^9$ | Present |
| Example 9 | Ketjen black | $10^9$ | Present |
| Example 10 | Ketjen black | $10^9$ | Present |
| Example 11 | Ketjen black | $10^9$ | Present |
| Example 12 | Ketjen black | $10^9$ | Present |
| Example 13 | Ketjen black | $10^{11}$ | Present |
| Example 14 | $CF_3SO_3Li$ | $10^{13}$ | Present |
| Example 15 | Ketjen black $CF_3SO_3Li$ | $10^{12}$ | Present |
| Example 16 | None | $>10^{14}$ | Present |
| Example 17 | Ketjen black | $10^9$ | Present |
| Example 18 | Ketjen black | $10^9$ | Present |
| Example 19 | Ketjen black | $10^9$ | None |
| Comparative Example 1 | None | $>10^{14}$ | Present |
| Comparative Example 2 | None | $>10^{14}$ | Present |
| Comparative Example 3 | Ketjen black | $10^9$ | Present |
| Comparative Example 4 | None | $>10^{14}$ | Present |

| | surface layer of pressure roller | Voltage applied to fixing film | Voltage applied to pressure roller | peeling offset | Stain of pressure roller |
|---|---|---|---|---|---|
| Example 1 | Insulative | −600 V | 0 V | ⊙ | ○ |
| Example 2 | Insulative | −600 V | 0 V | Δ | ○ |
| Example 3 | Insulative | −600 V | 0 V | ⊙ | ○ |
| Example 4 | Insulative | −600 V | 0 V | ⊙ | ○ |
| Example 5 | Insulative | −600 V | 0 V | Δ | ○ |
| Example 6 | Insulative | −600 V | 0 V | ⊙ | ○ |
| Example 7 | Insulative | −600 V | 0 V | ⊙ | ○ |
| Example 8 | Insulative | −600 V | 0 V | ⊙ | ○ |
| Example 9 | Insulative | −600 V | 0 V | ⊙ | ○ |
| Example 10 | Insulative | −600 V | 0 V | ⊙ | ○ |
| Example 11 | Insulative | −600 V | 0 V | ⊙ | ○ |
| Example 12 | Insulative | −600 V | 0 V | ⊙ | ○ |
| Example 13 | Insulative | −600 V | 0 V | ○ | ○ |
| Example 14 | Insulative | −600 V | 0 V | ⊙ | ○ |
| Example 15 | Insulative | −600 V | 0 V | ⊙ | ○ |
| Example 16 | Insulative | −600 V | 0 V | Δ | ○ |
| Example 17 | Insulative | 0 V | 0 V | Δ | ○ |
| Example 18 | Insulative | −600 V | +400 V | ⊙ | ⊙ |
| Example 19 | Insulative | −600 V | 0 V | ⊙ | ○ |
| Comparative Example 1 | Insulative | 0 V | 0 V | X | ○ |
| Comparative Example 2 | Insulative | −600 V | 0 V | X | ○ |
| Comparative Example 3 | Insulative | −600 V | 0 V | X | ○ |
| Comparative Example 4 | Conductive | 0 V | 0 V | ⊙ | X |

Peeling offset

⊙: The peeling offset does not occur at all.

○: The peeling offset occurs very slightly and partially in a level which can be seen when looked at carefully.

Δ: The peeling offset occurs slightly and partially in a level which does not matter.

X: The peeling offset occurs in the shape of sharp streak in the whole area along a longitudinal direction.

Stain of pressure roller

⊙: The stain does not occur at all.

○: Slight stain occurs in the pressure roller, but does not adhere to the paper.

X: The pressure roller is stained severely, and the stain adheres to the paper.

For Comparative Example 1 to Comparative Example 3, the stain of the pressure roller is good, but bad peeling offset occurs. The reason is that there is no performance of attenuating peeled-off and electrically charged charge in the releasing layer 23*d* of the heat-resistant belt 23.

In addition, the resistance of the releasing layer 24*c* of the pressure roller 24 is decreased in Comparative Example 4. The peeling offset is good, but the pressure roller is significantly stained, so that the polluted toner is transferred to the paper.

For Examples 1, 3, 4, 6, and 7, good results are obtained for both the peeling offset and the stain of the pressure roller.

Example 2 shows improved peeling offset as compared with Comparative Example 1 to Comparative Example 3. However, when compared with Example 3, since the amount of addition of the polyvinylidene fluoride (PVDF) to the main binder fluorine resin is small, the results show deterioration in the effect of peeling offset. Therefore, it is desirable to set the amount of addition of polyvinylidene fluoride (PVDF) to 0.05 parts or more relative to 100 parts of the main binder fluorine resin.

Example 5 shows improved peeling offset as compared with Comparative Example 1 to Comparative Example 3. However, when compared with Example 6, since the amount of addition of the fluoroalkylsulfonic acid derivative to the fluorine resin is small, the results show deterioration in the effect of peeling offset. Therefore, it is desirable to set the amount of addition of the fluoroalkylsulfonic acid derivative to 0.05 parts or more relative to 100 parts of the fluorine resin.

For Example 8 and Example 9, a satisfactory effect is obtained using polyacrylonitrile (PAN) and polymethyl methacrylate (PMMA), similarly to the case of using polyvinylidene fluoride (PVDF). For Example 10 to Example 12, satisfactory results are also obtained using a disulfonic acid, a sulfonamide, or a sulfonamide, similarly to the case of using a sulfonic acid.

For Example 1, Example 13 and Example 16, it can be seen that when Ketjen black is incorporated as conductive particles to the adhesive layer 23*c*, as the volume resistance value of the adhesive layer 23*c* decreases, better results for the peeling offset are obtained.

From Example 14 and Example 15, it can be understood that if the adhesive layer 23*c* contains monomer electrolyte as a charging control agent, a good result is obtained for the peeling offset, even though the volume resistance value of the adhesive layer 23*c* is high.

From Example 17, it can be understood that the configuration, in which a voltage is not applied to the heat-resistant belt 23, is effective in Comparative Examples 1 to 3.

From Example 18, it is possible to increase the potential difference between the heat-resistant belt and the pressure roller by applying a voltage to both the heat-resistant belt 23 and the pressure roller 24 in the state in which there is no peeling offset and stain of the pressure roller. In addition, it is found that it is desirable to apply a voltage to any one of the fixing rotating member and the pressure member in a direction to press an image on a recording material against the recording material.

The voltage value applied to the heat-resistant belt 23 and the pressure roller 24 is not limited to the Examples, but it can be appropriately set to increase the potential difference between the heat-resistant belt 23 and the pressure roller 24. From Example 19, it can be understood that a good result can be obtained for the peeling offset even in the configuration in which the elastic layer 23*b* is not formed on the heat-resistant belt 23.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A fixing rotating member configured to, together with a pressure member, pinch and transport a recording material carrying an image, the fixing rotating member comprising:

a base material; and a releasing layer, wherein the releasing layer is made of at least one fluorine resin selected from among tetrafluoroethylene-perfluoroalkyl vinyl ether copolymer, ethylene-tetrafluoroethylene copolymer, and tetrafluoroethylene-hexafluoropropylene copolymer, the fluorine resin containing:

at least one polymer selected from among polyvinylidene fluoride, polyacrylonitrile, and polymethyl methacrylate; and monomer electrolyte, and wherein an amount of addition of the polymer to the fluorine resin is in the range of 0.01 parts to 5 parts relative to 100 parts of the fluorine resin.

2. The fixing rotating member according to claim 1, wherein the monomer electrolyte is a fluorinated surfactant.

3. The fixing rotating member according to claim 2, wherein the fluorinated surfactant is a fluoroalkylsulfonic acid derivative.

4. The fixing rotating member according to claim 3, wherein the fluoroalkylsulfonic acid derivative includes one of sulfonic acid, disulphonic acid, sulfonyl imide, and sulfonamide.

5. The fixing rotating member according to claim 3, wherein an amount of addition of the fluoroalkylsulfonic acid derivative to the fluorine resin is in the range of 0.01 parts to 5 parts relative to 100 parts of the fluorine resin.

6. The fixing rotating member according to claim 5, wherein an amount of addition of the fluoroalkylsulfonic acid derivative to the fluorine resin is in the range of 0.05 parts to 5 parts relative to 100 parts of the fluorine resin.

7. The fixing rotating member according to claim 1, further comprising an adhesive layer between the base material and the releasing layer, the adhesive layer containing a conductive particle.

8. The fixing rotating member according to claim 1, further comprising an adhesive layer between the base material and the releasing layer, the adhesive layer containing monomer electrolyte.

9. The fixing rotating member according to claim 1, further comprising an adhesive layer between the base material and the releasing layer, the adhesive layer including a conductive particle and monomer electrolyte.

10. The fixing rotating member according to claim 1, further comprising an elastic layer between the base material and the releasing layer.

11. The fixing rotating member according to claim 10, further comprising an adhesive layer between the elastic layer and the releasing layer, the adhesive layer containing a conductive particle.

12. The fixing rotating member according to claim 10, further comprising an adhesive layer between the elastic layer and the releasing layer, the adhesive layer containing monomer electrolyte.

13. The fixing rotating member according to claim 10, further comprising an adhesive layer between elastic layer and the releasing layer, the adhesive layer containing a conductive particle and monomer electrolyte.

14. The fixing rotating member according to claim 1, wherein the releasing layer is a tube.

15. The fixing rotating member according to claim 1, wherein an amount of addition of the polymer to the fluorine resin is in the range of 0.05 parts to 5 parts relative to 100 parts of the fluorine resin.

16. The fixing rotating member according to claim 1, wherein the fixing rotating member is an endless belt.

17. The fixing rotating member according to claim 1, wherein the fixing rotating member is a heat roller.

18. A fixing device comprising:

a fixing rotating member including a base material and a releasing layer; and a pressure member forming, together with the fixing rotating member, a nip portion configured to heat, while pinching and transporting, a recording material carrying an image, wherein the releasing layer is made of at least one fluorine resin selected from among tetrafluoroethylene-perfluoroalkyl vinyl ether copolymer, ethylene-tetrafluoroethylene copolymer, and tetrafluoroethylene-hexafluoropropylene copolymer, the fluorine resin containing:

at least one polymer selected from among polyvinylidene fluoride, polyacrylonitrile, and polymethyl methacrylate; and monomer electrolyte, and wherein an amount of addition of the polymer to the fluorine resin is in the range of 0.01 parts to 5 parts relative to 100 parts of the fluorine resin.

19. The fixing device according to claim 18, further comprising a voltage applying member provided for at least one of the fixing rotating member and the pressure member to apply a voltage to an image on the recording material in a direction to press the image against the recording material.

20. The fixing device according to claim 18, wherein an amount of addition of the polymer to the fluorine resin is in the range of 0.05 parts to 5 parts relative to 100 parts of the fluorine resin.

21. The fixing device according to claim 18, wherein the monomer electrolyte is a fluorinated surfactant.

22. The fixing device according to claim 21, wherein the fluorinated surfactant is a fluoroalkylsulfonic acid derivative.

23. The fixing device according to claim 22, wherein the fluoroalkylsulfonic acid derivative includes one of sulfonic acid, disulphonic acid, sulfonyl imide, and sulfonamide.

24. The fixing device according to claim 22, wherein an amount of addition of the fluoroalkylsulfonic acid derivative to the fluorine resin is in the range of 0.01 parts to 5 parts relative to 100 parts of the fluorine resin.

25. The fixing device according to claim 24, wherein an amount of addition of the fluoroalkylsulfonic acid derivative to the fluorine resin is in the range of 0.05 parts to 5 parts relative to 100 parts of the fluorine resin.

26. The fixing device according to claim 18, further comprising an adhesive layer between the base material and the releasing layer, the adhesive layer containing at least one of a conductive particle and monomer electrolyte.

27. The fixing device according to claim 18, further comprising an elastic layer between the base material and the releasing layer.

28. The fixing device according to claim 27, further comprising an adhesive layer between the elastic layer and the releasing layer, the adhesive layer containing at least one of a conductive particle and monomer electrolyte.

29. The fixing device according to claim 18, wherein the releasing layer is a tube.

30. The fixing device according to claim 18, wherein the fixing rotating member is an endless belt.

31. The fixing device according to claim 30, further comprising a heater, wherein the heater being in contact with an inner surface of the endless belt.

32. The fixing device according to claim 18, wherein the fixing rotating member is a heat roller.

33. A fixing rotating member configured to, together with a pressure member, pinch and transport a recording material carrying an image, the fixing rotating member comprising:

a base material;

a releasing layer, and an adhesive layer arranged between the base material and the releasing layer, wherein the releasing layer is made of at least one fluorine resin selected from among tetrafluoroethylene-perfluoroalkyl vinyl ether copolymer, ethylene-tetrafluoroethylene copolymer, and tetrafluoroethylene-hexafluoropropylene copolymer, the fluorine resin containing:

at least one polymer selected from among polyvinylidene fluoride, polyacrylonitrile, and polymethyl methacrylate; and monomer electrolyte, and wherein the adhesive layer containing monomer electrolyte.

34. The fixing rotating member according to claim 33, wherein the adhesive layer further containing a conductive particle.

35. The fixing rotating member according to claim 33, wherein the fixing rotating member is an endless belt.

36. A fixing rotating member configured to, together with a pressure member, pinch and transport a recording material carrying an image, the fixing rotating member comprising:

a base material;

a releasing layer, and an elastic layer arranged between the base material and the releasing layer, wherein the releasing layer is made of at least one fluorine resin selected from among tetrafluoroethylene-perfluoroalkyl vinyl ether copolymer, ethylene-tetrafluoroethylene copolymer, and tetrafluoroethylene-hexafluoropropylene copolymer, the fluorine resin containing:

at least one polymer selected from among polyvinylidene fluoride, polyacrylonitrile, and polymethyl methacrylate; and monomer electrolyte.

37. The fixing rotating member according to claim 36, further comprising an adhesive layer between the elastic layer and the releasing layer, the adhesive layer containing at least one of a conductive particle and monomer electrolyte.

38. The fixing rotating member according to claim 36, wherein the fixing rotating member is an endless belt.

* * * * *